US010603773B2

(12) United States Patent
Kondou

(10) Patent No.: US 10,603,773 B2
(45) Date of Patent: Mar. 31, 2020

(54) DRIVING TOOL

(71) Applicant: MAX CO., LTD., Tokyo (JP)

(72) Inventor: Yoshihiko Kondou, Tokyo (JP)

(73) Assignee: MAX CO., LTD., Tokyo (JP)

( * ) Notice: Subject to any disclaimer, the term of this patent is extended or adjusted under 35 U.S.C. 154(b) by 283 days.

(21) Appl. No.: 15/454,114

(22) Filed: Mar. 9, 2017

(65) Prior Publication Data

US 2017/0259417 A1 Sep. 14, 2017

(30) Foreign Application Priority Data

Mar. 11, 2016 (JP) ..... 2016-048962

(51) Int. Cl.
*B25C 1/00* (2006.01)
*B25C 1/06* (2006.01)

(52) U.S. Cl.
CPC ..... *B25C 1/008* (2013.01); *B25C 1/06* (2013.01)

(58) Field of Classification Search
CPC .. B25C 1/008; B25C 1/08; B25C 1/06; B25C 1/04; B25C 1/047; B25C 1/043; B25C 1/188
USPC ..... 227/8–10, 123, 129–132
See application file for complete search history.

(56) References Cited

U.S. PATENT DOCUMENTS 4,298,072 A 11/1981 Baker et al.
4,403,722 A * 9/1983 Nikolich ..... B25C 1/008 227/10
5,605,268 A * 2/1997 Hayashi ..... B25C 5/15 227/131
5,667,127 A * 9/1997 Ichikawa ..... B25C 1/008 227/142
5,791,545 A * 8/1998 Lin ..... B25C 1/008 227/130
5,875,227 A * 2/1999 Bhatt ..... H01J 35/101 378/132
6,886,729 B1 * 5/2005 Lee ..... B25C 1/008 227/130

(Continued)

FOREIGN PATENT DOCUMENTS

DE A1-4442657 6/1995
JP H09-201781 A 8/1997
WO WO-A1-2010-001912 1/2010

OTHER PUBLICATIONS

Extended European Search Report dated Oct. 11, 2017 in corresponding European patent application 17000380.8 (8 pages).

*Primary Examiner* — Andrew M Tecco
*Assistant Examiner* — Eyamindae C Jallow
(74) *Attorney, Agent, or Firm* — Rothwell, Figg, Ernst & Manbeck, P.C.

(57) ABSTRACT

A driving tool is configured to drive fasteners shot from an ejection port into a driving target. The driving tool includes a trigger configured to carry out a driving action, a nose part formed with the ejection port, a contact member provided to be slidable relative to the nose part and is capable of being pressed against the driving target, and a contact detecting part configured to detect that the contact member is pressed against the driving target. The driving action is carried out when the contact detecting part detects that the contact member is pressed against the driving target and when the trigger is operated. The contact member is slidable to a side opposite to and beyond a tip of the nose part.

12 Claims, 13 Drawing Sheets

(56) References Cited

U.S. PATENT DOCUMENTS

| | | | | |
|---|---|---|---|---|
| 7,182,236 | B1 * | 2/2007 | Wen | B25C 1/005 227/120 |
| 2008/0296337 | A1 * | 12/2008 | Yang | B25C 1/008 227/8 |
| 2011/0168753 | A1 * | 7/2011 | Wu | B25C 1/005 227/8 |
| 2012/0267416 | A1 * | 10/2012 | Wong | B25C 1/008 227/8 |

* cited by examiner

DRIVING TOOL

CROSS-REFERENCE TO RELATED APPLICATION

This application claims priority from Japanese Patent Application No. 2016-048962 filed on Mar. 11, 2016, the entire contents of which are incorporated herein by reference.

FIELD

The present invention relates to a driving tool configured to drive fasteners such as nails or screws into a driving target, and particularly to a driving tool capable of deeply driving fasteners even in performing oblique driving.

BACKGROUND

As this type of driving tool, a driving tool equipped with a contact member that is provided to be slidable relative to a nose part and is pressed against a driving target is known.

This driving tool is formed such that fasteners cannot be shot when the contact member is not pressed against the driving target and thereby the fasteners are not shot in the air (for example, see Japanese Unexamined Patent Application Publication No. H09-201781).

Meanwhile, in the conventional driving tool, a top dead center of the contact member when the contact member is pushed into the back is equal to a tip of the nose part, but is set to such a degree as to slightly protrude from the tip of the nose part. By setting the top dead center in this way, the contact member can be moved to the top dead center when the contact member is pressed against the flat driving target, and a sign for validating an operation of a trigger can be reliably turned on. In other words, it is possible to prevent an incomplete sign from being generated by pressing shortage of the contact member.

However, in the conventional driving tool as mentioned above, when an attempt is made to incline the tool to shoot the fasteners (when an attempt is made to perform so-called oblique driving), there is a problem that a gap occurs between the tip of the nose part and the driving target when the contact member is pressed against the driving target and is moved to the top dead center, and the fasteners cannot be deeply driven.

In the conventional driving tool, when the driving tool falls from a tip side thereof, the contact member bears the whole impact at the time of falling. For this reason, there is a problem that the contact member leads to breakage.

Accordingly, an object of the invention is to provide a driving tool capable of deeply driving fasteners even when oblique driving is performed and preventing breakage of a contact member.

To address the above problems, the invention is characterized by the following.

A driving tool configured to drive fasteners shot from an ejection port into a driving target according to an aspect of the invention comprises:

a trigger configured to carry out a driving action;

a nose part formed with the ejection port;

a contact member provided to be slidable relative to the nose part and is capable of being pressed against the driving target; and a contact detecting part configured to detect that the contact member is pressed against the driving target, wherein the driving action is carried out when the contact detecting part detects that the contact member is pressed against the driving target and when the trigger is operated, and wherein the contact member is slidable to a side opposite to and beyond a tip of the nose part.

In the driving tool according to an aspect of the invention, the contact detecting part may include a button capable of being pushed down in a direction perpendicular to a sliding direction of the contact member.

In the driving tool according to an aspect of the invention, a tip width of the contact member may be greater than a tip width of the nose part.

In the driving tool according to an aspect of the invention, the driving tool may include an adjustment member configured to adjust a movable range of the contact member, and the adjustment member may have a first state and a second state, in the first state, a tip of the contact member is made slidable to the side opposite to and beyond the tip of the nose part, and in the second state, the tip of the contact member is regulated not to be slidable to the side opposite to and beyond the tip of the nose part.

In the driving tool according to an aspect of the invention, the adjustment member may be a member mounted to be rotatable relative to the nose part, be formed such that a distance from a rotational center to a circumferential surface differs in at least two spots, and decide a top dead center of the contact member by engaging the contact member with the circumferential surface.

In the driving tool according to an aspect of the invention, the adjustment member may be disposed at a front side of the driving tool.

In the driving tool according to an aspect of the invention, the adjustment member may be regulable such that the contact member does not slide to a position at which the contact detecting part detects that the contact member is pressed against the driving target.

According to the aspect of the invention, the contact member is made slidable to the side opposite to and beyond the tip of the nose part. According to this configuration, when the contact member is obliquely pressed against the driving target and is moved to the top dead center thereof, the contact member can be pushed into the back beyond the tip of the nose part. For this reason, since the tip of the nose part can approach the driving target, the fasteners can be deeply driven even when the oblique driving is performed. Even when the contact member is pressed against the driving target on the straight (in the case of so-called flat driving), since the tip of the nose part can be brought into close contact with the driving target, the fasteners can be deeply driven.

Even when the driving tool falls from a tip side thereof, it is difficult for the contact member to be broken. That is, the contact member slides, and thereby the nose part is hit against the ground so that an impact is dispersed to the contact member and the nose part (the tool main body). For this reason, it is possible to prevent breakage of the contact member at the time of falling.

According to the aspect of the invention, the contact detecting part includes the button that is allowed to be pushed down in the direction perpendicular to the sliding direction of the contact member. According to this configuration, even when the contact member is not moved to the top dead center thereof, the contact detecting part can be disposed such that the button is pushed down in the middle of the range in which the contact member slides. Therefore, even when the contact member is not moved to the top dead center thereof at the time of flat driving, a sign for validating an operation of a trigger can be reliably turned on, and no sign failure occurs at the time of flat driving. Even when the contact detecting part is disposed such the button is pushed down in the middle of sliding, since the contact detecting part does not hinder the sliding of the contact member, the movable range of the contact member can be freely set.

According to the aspect of the invention, the tip width of the contact member is formed to be greater than that of the nose part. According to this configuration, when the oblique driving is performed by pressing a lateral end of the contact member against the driving target, the lateral end of the contact member which protrudes from a side of the nose part can be engaged with the driving target. Therefore, the nose part can be prevented from sliding on the driving target when a pressing action of the contact member is performed, and a posture during driving can be stabilized.

According to the aspect of the invention, the driving tool includes the adjustment member for adjusting the movable range of the contact member, and the adjustment member acquires the first state in which the tip of the contact member is made slidable to the side opposite to and beyond the tip of the nose part and the second state in which the tip of the contact member is regulated not to be slidable to the side opposite to and beyond the tip of the nose part. According to this configuration, the movable range of the contact member can be adjusted according to circumstances of usage. For example, adjustment that the adjustment member is set to the first state at the time of oblique driving and is set to the second state at the time of flat driving is made possible.

According to the aspect of the invention, the adjustment member is the member mounted to be rotatable relative to the nose part, is formed such that the distance from the rotational center thereof to the circumferential surface thereof differs in at least two spots, and decides the top dead center of the contact member by engaging the contact member with the circumferential surface thereof. According to this configuration, since the movable range of the contact member can be adjusted only by rotating the adjustment member, operability is good.

Since the adjustment member is directly engaged with the contact member, a driving depth can be adjusted with the minimum number of components. Since no intermediate member is used, only a tolerance between the adjustment member and the contact member may be taken into consideration, and an adjustment mechanism having high accuracy can be provided.

If the distance from the rotational center to the circumferential surface is set to be able to be changed step by step, the adjustment mechanism capable of adjusting the driving depth step by step can be provided. If the circumferential surface of the adjustment member is formed in a cam shape, the adjustment mechanism capable of steplessly adjusting the driving depth in a seamless way can be provided.

According to the aspect of the invention, the adjustment member is disposed at the front side of the driving tool. According to this configuration, since visibility of the side of the driving tool is not marred, driving work can be performed while looking at a driving position from the side.

According to the aspect of the invention, the adjustment member is regulable such that the contact member does not slide to the position at which the contact detecting part detects the pressing. According to this configuration, the contact member can be locked such that the driving cannot be performed by the adjustment member for adjusting the driving depth.

BRIEF DESCRIPTION OF DRAWINGS

FIGS. 4A and 4B are external perspective views of the driving tool in which an adjustment member is set to a first state when viewed from the front, wherein FIG. 4A is a view of a state prior to being pressed against a driving target, and FIG. 4B is a view of a state after being pressed against the driving target;

FIGS. 5A and 5B are side views of the driving tool in which the adjustment member is set to the first state, wherein FIG. 5A is a view of the state prior to being pressed against the driving target, and FIG. 5B is a view of the state after being pressed against the driving target;

FIGS. 6A and 6B are external perspective views of the driving tool in which the adjustment member is set to the first state when viewed from the front, wherein FIG. 6A is a view of the state prior to being pressed against a driving target, and FIG. 6B is a view of the state after being pressed against the driving target;

FIGS. 7A and 7B are side views of the driving tool in which the adjustment member is set to a second state, wherein FIG. 7A is a view of the state prior to being pressed against the driving target, and FIG. 7B is a view of the state after being pressed against the driving target;

FIGS. 10A to 10F are views illustrating an adjustment member according to a first modification, wherein FIG. 10A is a view of the state prior to being pressed against the driving target when a driving depth is set to the maximum driving depth, FIG. 10B is a view of the state after being pressed against the driving target when the driving depth is set to the maximum driving depth, FIG. 10C is a view of the state prior to being pressed against the driving target when the driving depth is set to the minimum driving depth, FIG. 10D is a view of the state after being pressed against the driving target when the driving depth is set to the minimum driving depth, FIG. 10E is a view of the state prior to being pressed against the driving target when the driving depth is set to an intermediate driving depth, and FIG. 10F is a view of the state after being pressed against the driving target when the driving depth is set to the intermediate driving depth;

FIGS. 11A to 11F are views illustrating an adjustment member according to a second modification, wherein FIG. 11A is a view of the state prior to being pressed against the driving target when the driving depth is set to the maximum driving depth, FIG. 11B is a view of the state after being pressed against the driving target when the driving depth is set to the maximum driving depth, FIG. 11C is a view of the state prior to being pressed against the driving target when the driving depth is set to the minimum driving depth, FIG. 11D is a view of the state after being pressed against the driving target when the driving depth is set to the minimum driving depth, FIG. 11E is a view of the state prior to being pressed against the driving target when the driving depth is set to the intermediate driving depth, and FIG. 11F is a view of the state after being pressed against the driving target when the driving depth is set to the intermediate driving depth;

FIGS. 13A and 13B are views illustrating a state in which the oblique driving is performed by a conventional driving tool, wherein FIG. 13A is a view when viewed from the side, and FIG. 13B is a view when viewed from the front.

DETAILED DESCRIPTION

Embodiments of the invention will be described with reference to the drawings.

A driving tool 10 according to the present embodiment is configured to shoot fasteners such as screws or nails from an ejection port 10*a* and drive the fasteners into a driving target 50. The driving tool 10 is configured to drive the fasteners using a driver that is vertically driven by a given power source. In the present embodiment, a driving action is performed using a battery pack 40 provided to be mountable/demountable on/from a tool main body 11 as the power source. The power source of the driving tool 10 is not limited to the battery pack 40. For example, the driving action may be performed using compressed air or using combustion pressure of a combustible gas.

Figure 1:
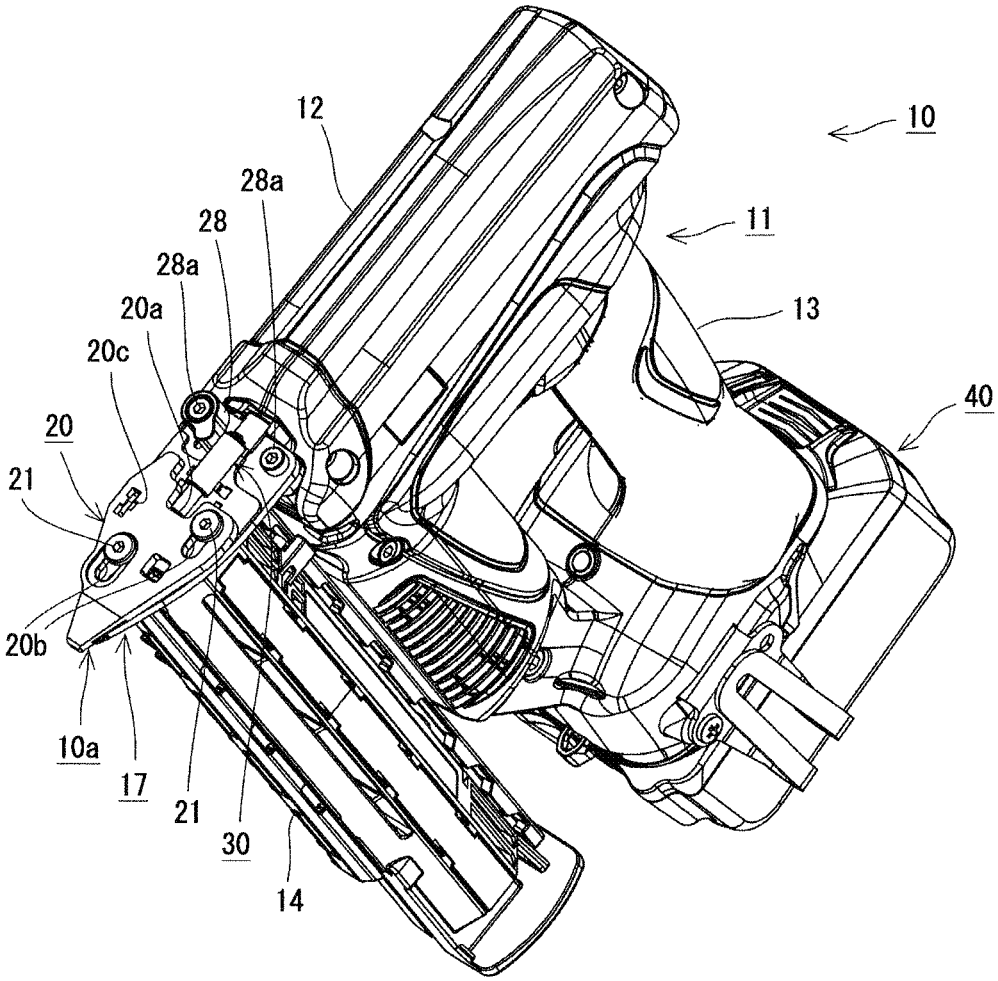
FIG. 1 is an external perspective view of a driving tool viewed from the left side.

As illustrated in FIG. 1, the tool main body 11 of the driving tool 10 is provided with an output part 12 in which an actuating mechanism or the like for performing the driving action is accommodated, a grip part 13 that is connected to the output part 12 at approximately right angles, a trigger 15 provided for the grip part 13, a nose part 17 that is integrally fixed to a tip side (in a driving direction of the fasteners) of the output part 12 in an axial direction, and a magazine 14 that is connected in the rear of the nose part 17.

The trigger 15 is an operating part for performing the driving action, and is provided at a position at which the trigger 15 can be operated with an index finger when the grip part 13 is grasped. When this trigger 15 is pulled in a state in which a sign of a contact detecting part 22 (to be described below) is turned on, the actuating mechanism accommodated in the output part 12 is operated, and the driving action is performed.

Since the magazine 14 accommodates the fasteners ejected from the ejection port 10*a*, the magazine 14 accommodates the fasteners connected to one another. The fasteners accommodated in the magazine 14 are sequentially guided in a direction of the nose part 17, and are used for driving.

The nose part 17 is a part in which the ejection port 10*a* ejecting the fasteners is formed, and is formed at a tip of the tool main body 11 in a protruding form. The driver (not shown) for driving the fasteners is slidably accommodated inside the nose part 17. A fastener feeding mechanism is provided in the rear of the nose part 17. The fastener feeding mechanism is interlocked with the driving action and performs a feeding action. The fasteners accommodated in the magazine 14 are sequentially fed to the nose part 17 by this feeding action.

A contact member 20 pressed against the driving target 50 is mounted in the front of the nose part 17 to be slidable relative to the nose part 17.

The contact member 20 according to the present embodiment is slidably mounted on the nose part 17 by fixing tools 21 such as pins. Long holes 20*b* for inserting the fixing tools 21 are formed in the contact member 20 in a penetrated form. Since the long holes 20*b* extend in a sliding direction of the contact member 20, the contact member 20 is made slidable vertically along the long holes 20*b*.

This contact member 20 is made slidable upward relative to the nose part 17 when pressed against the driving target 50. The contact member 20 slides upward in this way, and thereby a safety mechanism of the driving action is configured to be actuated. An the safety mechanism is actuated, thereby, an operation of the trigger 15 is validated, and the fasteners can be driven.

Figure 2:
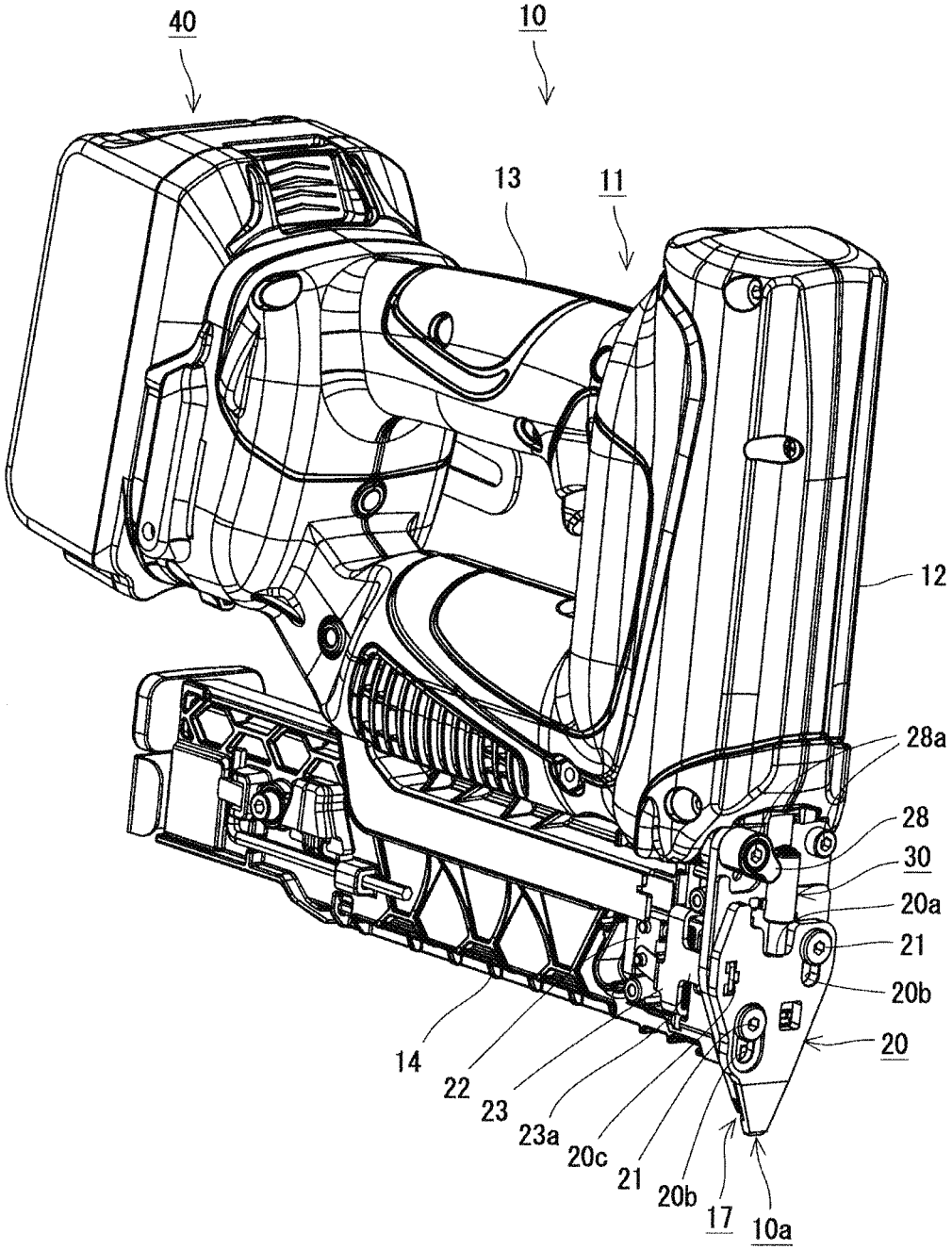
FIG. 2 is an external perspective view of the driving tool viewed from the right side, and is a view of a state in which an inside of a magazine is exposed.
Figure 3:
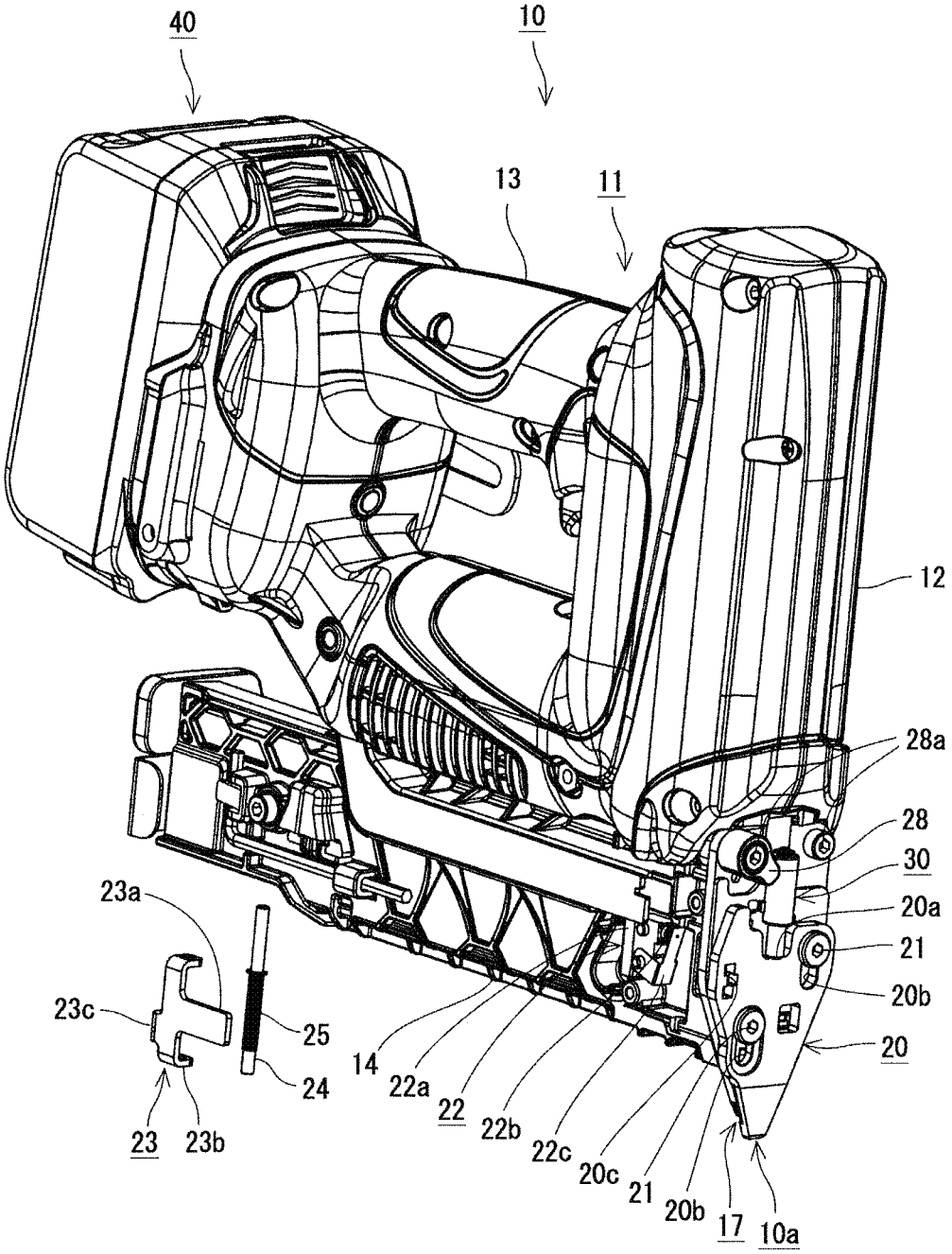
FIG. 3 is an external perspective view of the driving tool viewed from the right side, and is a view of a state in which a switch depressing member is removed.

To be specific, as illustrated in FIGS. 2 and 3, the safety mechanism is accommodated inside the magazine 14, and is provided with the contact detecting part 22, a switch depressing member 23, and a sliding support shaft 24.

The contact detecting part 22 is a switch configured to detect that the contact member 20 is pressed against the driving target 50. When the trigger 15 is operated with the contact detecting part 22 turned on, the driving action is performed. The contact detecting part 22 is provided with a switch box 22*a* in which components are accommodated, a button 22*b* that is provided by protruding from the switch box 22*a*, and a swinging member 22*c* that is mounted to cover the button 22*b*.

The button 22*b* protrudes to face the back of the nose part 17, and can be pushed down in a direction (in the left direction in FIGS. 5A and 5B) perpendicular to the sliding direction of the contact member 20. It will be sufficient if the button 22*b* can be pushed down in the direction perpendicular to the sliding direction of the contact member 20, and the button 22*b* need not necessarily protrude in the direction perpendicular to the sliding direction of the contact member 20. For example, the button 22*b* may protrude to be oblique with respect to the sliding direction of the contact member 20. However, in order for the button 22*b* to be reliably pushed down by the contact member 20 while disposing the switch box 22*a* so as not to hinder the sliding of the contact member 20, a surface of the switch box 22*a* is preferably parallel to the sliding direction of the contact member 20, and the button 22*b* preferably protrudes in the direction perpendicular to the sliding direction of the contact member 20. When this button 22*b* is pushed down, a detection signal is sent from the contact detecting part 22. When an operation signal of the trigger 15 is detected in a state in which this detection signal is output, the driving action is performed.

The swinging member 22*c* is swingably mounted on the switch box 22*a*, and covers the front of the button 22*b*. This swinging member 22*c* is obliquely mounted to face a switch depressing part 23*c* of the switch depressing member 23 (to be described below), is pushed by the switch depressing part 23*c* when the switch depressing member 23 moves up, and is swung to push down the button 22*b*. This swinging member 22*c* is provided, and thereby is configured such the button 22*b* is pushed down even when the contact member 20 is not moved to a top dead center thereof. The swinging member 22*c* is arranged so as not to prevent the movement of the switch depressing member 23*c* toward the side opposite to the tip of the nose part 17 after the swinging member 22*c* pushed down the button 22*b*.

The switch depressing member 23 is a member that is vertically moved integrally with the contact member 20 and actuates the contact detecting part 22. This switch depressing member 23 is a metal fitting as illustrated in FIG. 3, and is provided with a protrusion piece 23*a* protruding to the front thereof, a spring receiving part 23*b* formed at a lower portion thereof, and the switch depressing part 23*c* protruding to the rear thereof.

The protrusion piece 23*a* is a part for engagement with the contact member 20, and is engaged with an insertion hole 20*c* formed in the contact member 20 as illustrated in FIG. 2. Thereby, when the contact member 20 is vertically moved, the switch depressing member 23 is also configured to be vertically moved integrally with the contact member 20.

The spring receiving part 23*b* is a part for receiving a biasing force of a return spring 25 of the sliding support shaft 24 (to be described below). This spring receiving part 23*b* receives the biasing force of the return spring 25, and thereby the switch depressing member 23 is consistently biased downward. Thereby, the switch depressing member 23 is prevented from unintentionally moving upward, and prevents erroneous detection of the contact detecting part 22.

The switch depressing part 23*c* is a part for pushing down the button 22*b* when the contact member 20 is moved up, and is disposed to face the swinging member 22*c* mentioned above. When the contact member 20 is moved up and the switch depressing member 23 is integrally moved up, the swinging member 22*c* is swung by the switch depressing part 23*c* such that the button 22*b* is pushed down.

The sliding support shaft 24 is a part for guiding vertical movement of the switch depressing member 23. The return spring 25 for biasing the switch depressing member 23 downward is mounted on the sliding support shaft 24.

Figure 4A:
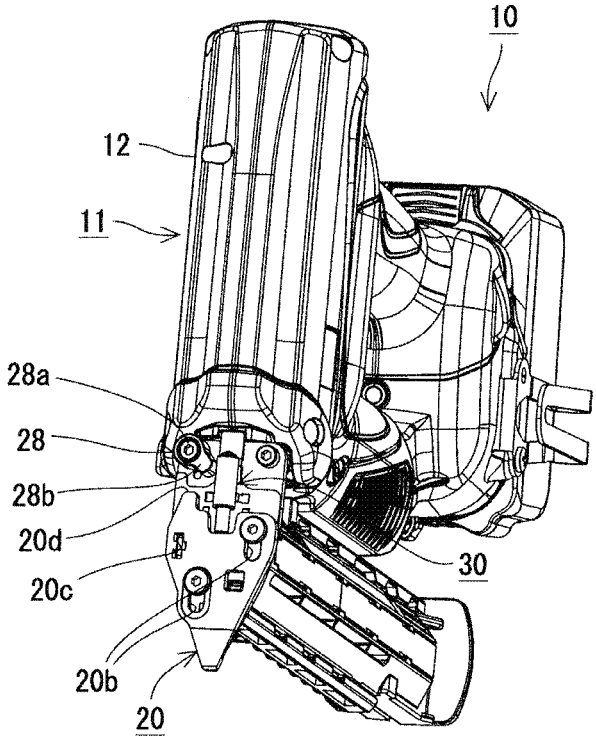
Figure 5A:
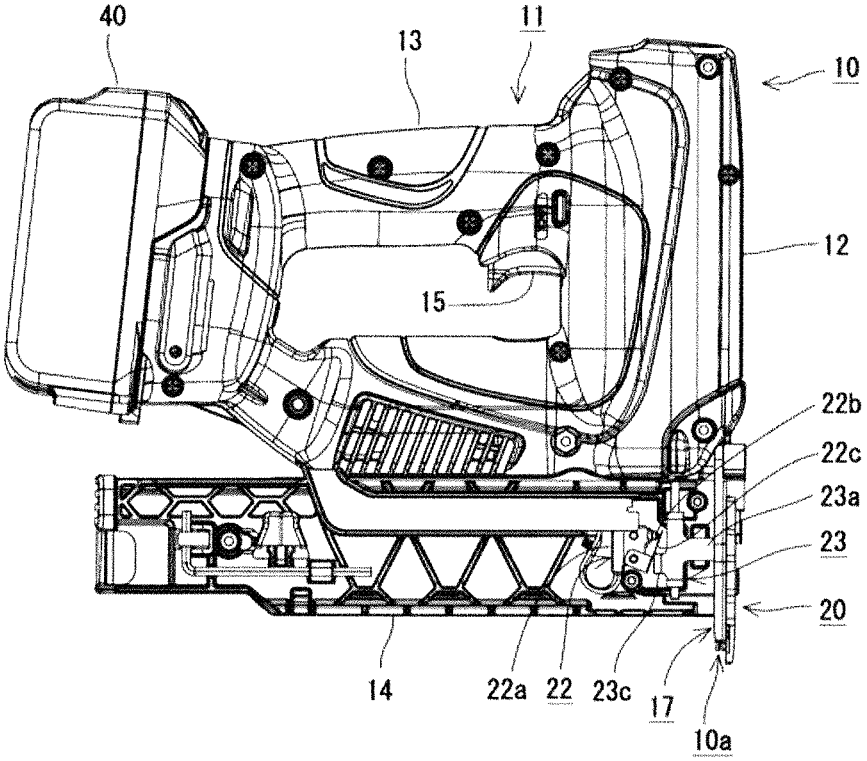

The contact member 20 is consistently biased in a protruding direction by biasing unit 30, and is in a state in which it protrudes from the tip of the nose part 17 in a state in which it is not pressed against the driving target 50 as illustrated in FIGS. 4A and 5A.

Figure 9A:
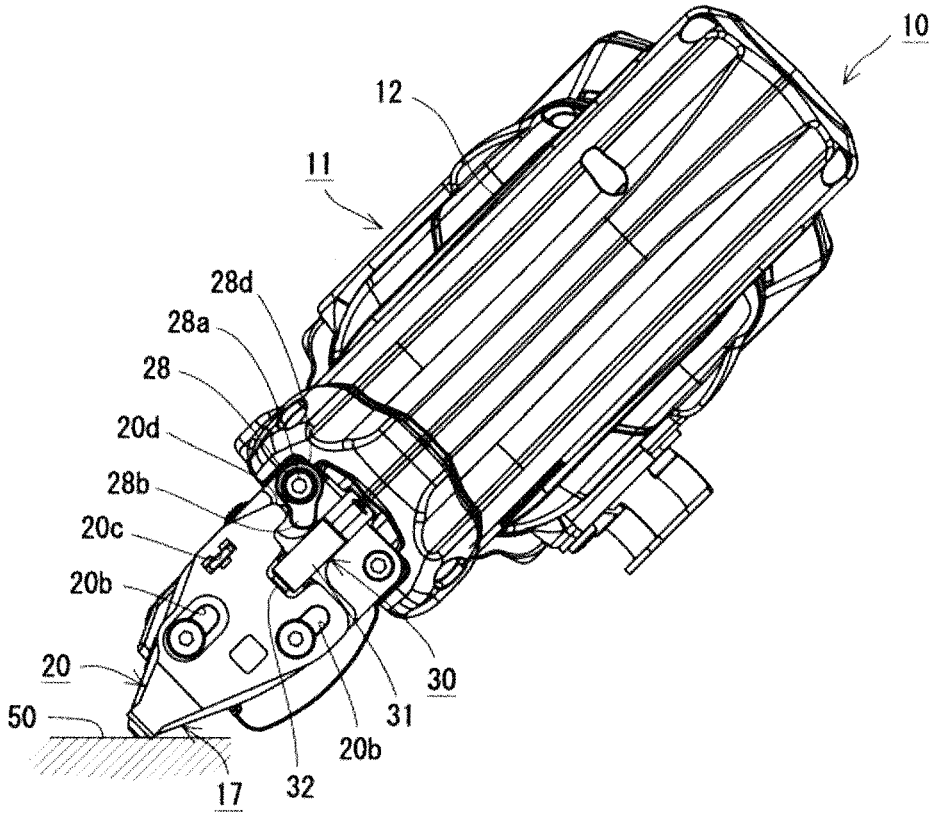
FIG. 9A is a view of the driving tool when oblique driving is performed when viewed from the side.
Figure 9B:
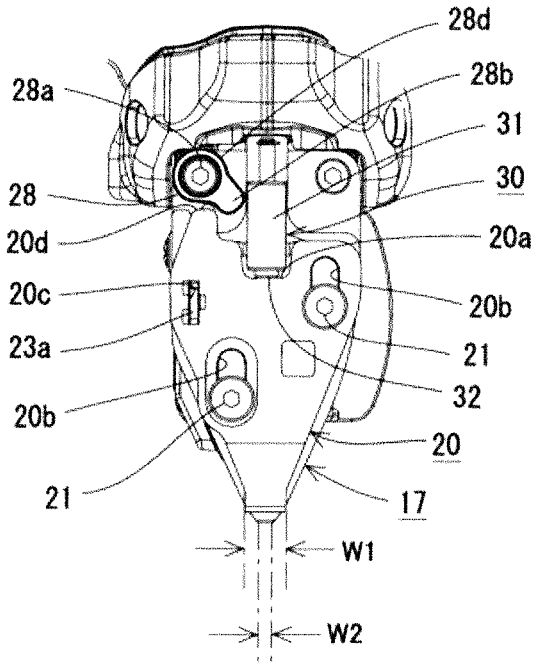
FIG. 9B is a view in which a vicinity of a contact member is enlarged.
Figure 10A:
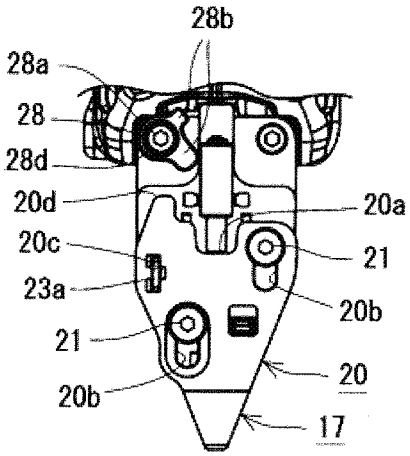
Figure 10B:
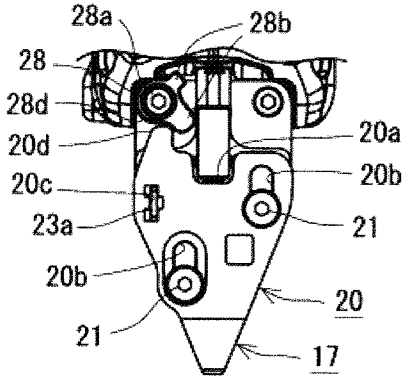
Figure 10C:
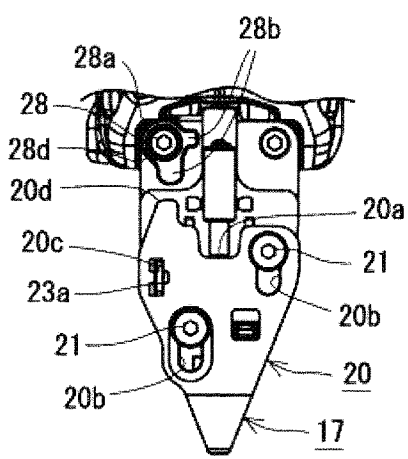
Figure 10D:
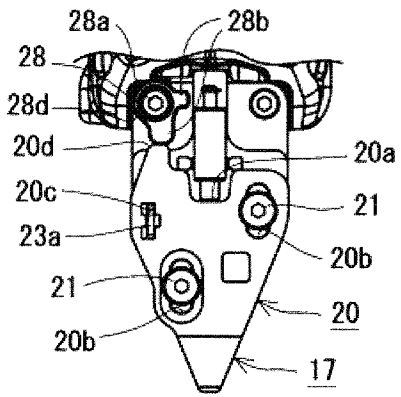
Figure 10E:
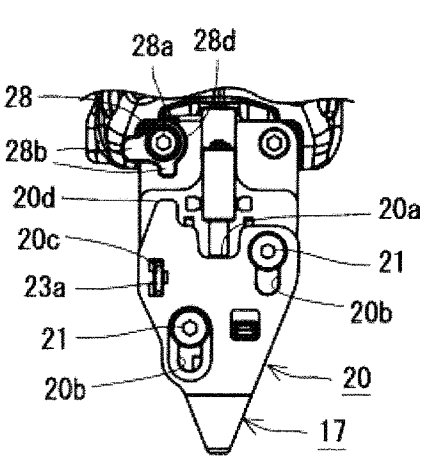
Figure 10F:
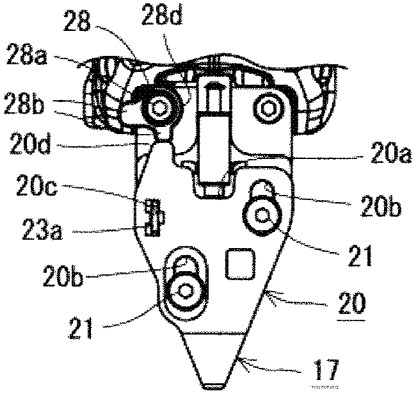
Figure 11A:
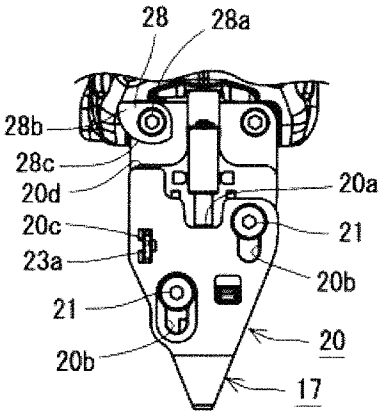
Figure 11B:
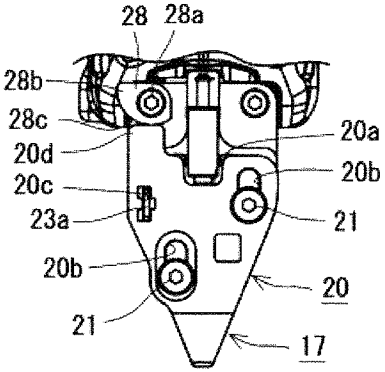
Figure 11C:
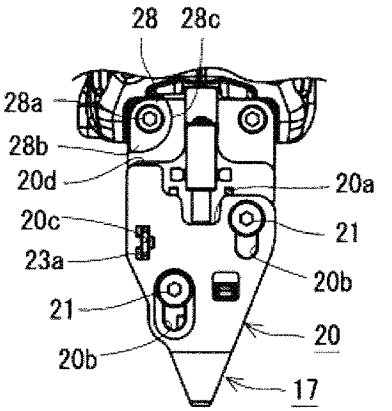
Figure 11D:
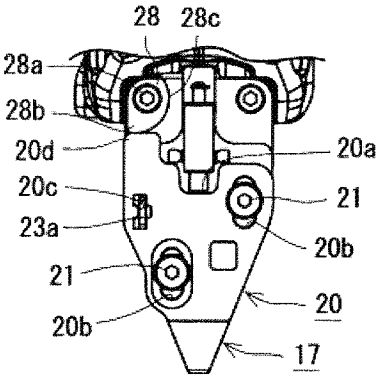
Figure 11E:
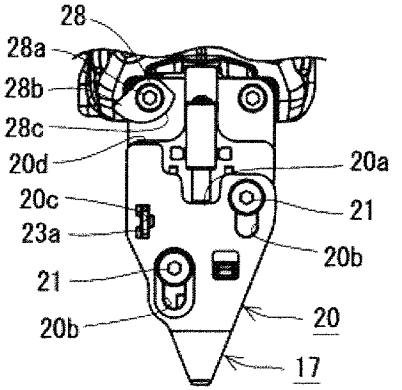
Figure 11F:
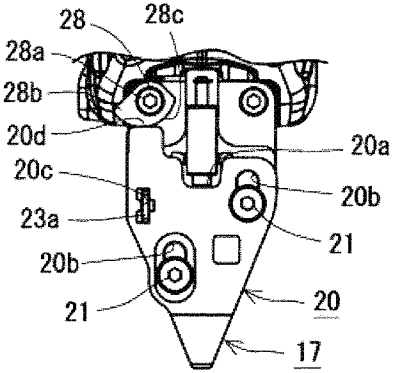

As illustrated in FIG. 9B, the biasing unit 30 for biasing the contact member 20 is provided with a tubular part 31 that is fixed to the nose part 17, a shaft part 32 that is provided to be able to be projected and retracted from the tubular part 31, and a spring (not shown) that is accommodated in the tubular part 31 and biases the shaft part 32 in the protruding direction. A tip of the shaft part 32 is engaged with a recess 20*a* formed at the other tip side of the contact member 20, and biases the contact member 20 in a direction of the tip of the contact member 20.

Figure 4B:
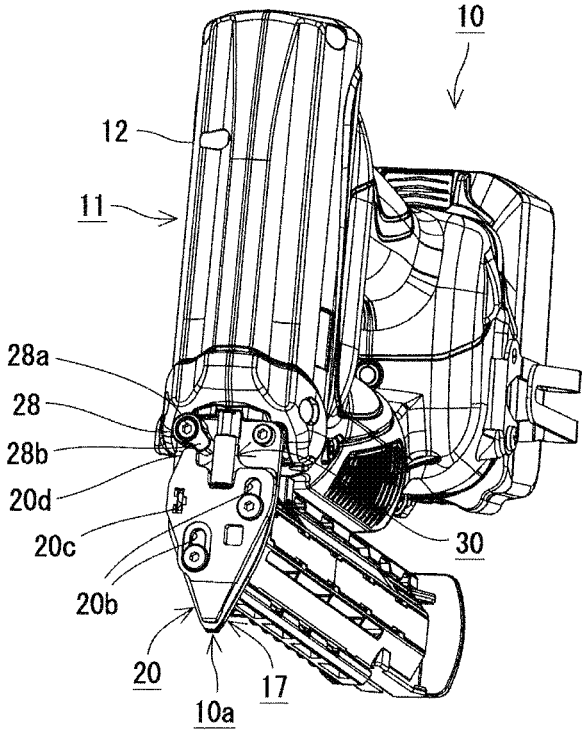
Figure 5B:
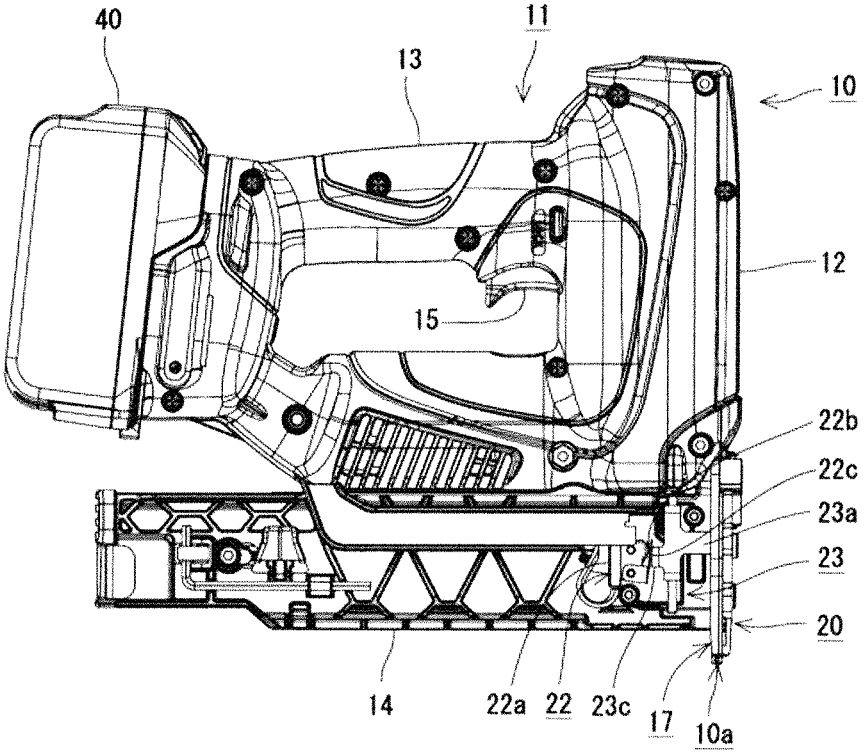
Figure 8:
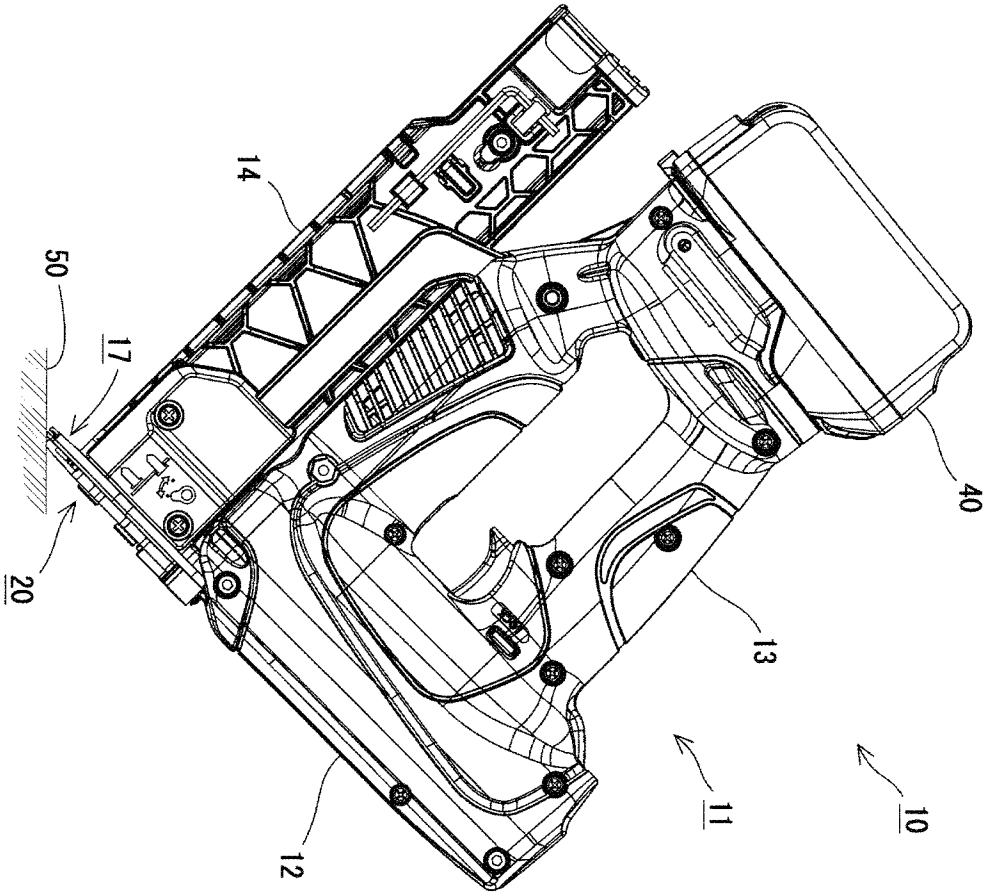
FIG. 8 is a view of the driving tool when oblique driving is performed when viewed from the side.

When the contact member 20 is pressed against the driving target 50, the contact member 20 slides in a direction opposite to the protruding direction against the biasing force of the biasing unit 30. That is, as illustrated in FIGS. 4B and 5B, the contact member 20 is moved upward. On this occasion, the contact member 20 is slidable to a position at which the tip of the contact member 20 becomes an opposite side of the tip of the nose part 17 and beyond the tip of the nose part 17. For this reason, as illustrated in FIG. 8, even when the driving tool 10 performs driving while being inclined with respect to the driving target 50, so-called oblique driving, the tip of the nose part 17 can approach the driving target 50. The tip of the nose part 17 approaches the driving target 50, and thereby the fasteners can be deeply driven even when the oblique driving is performed.

Figure 13B:
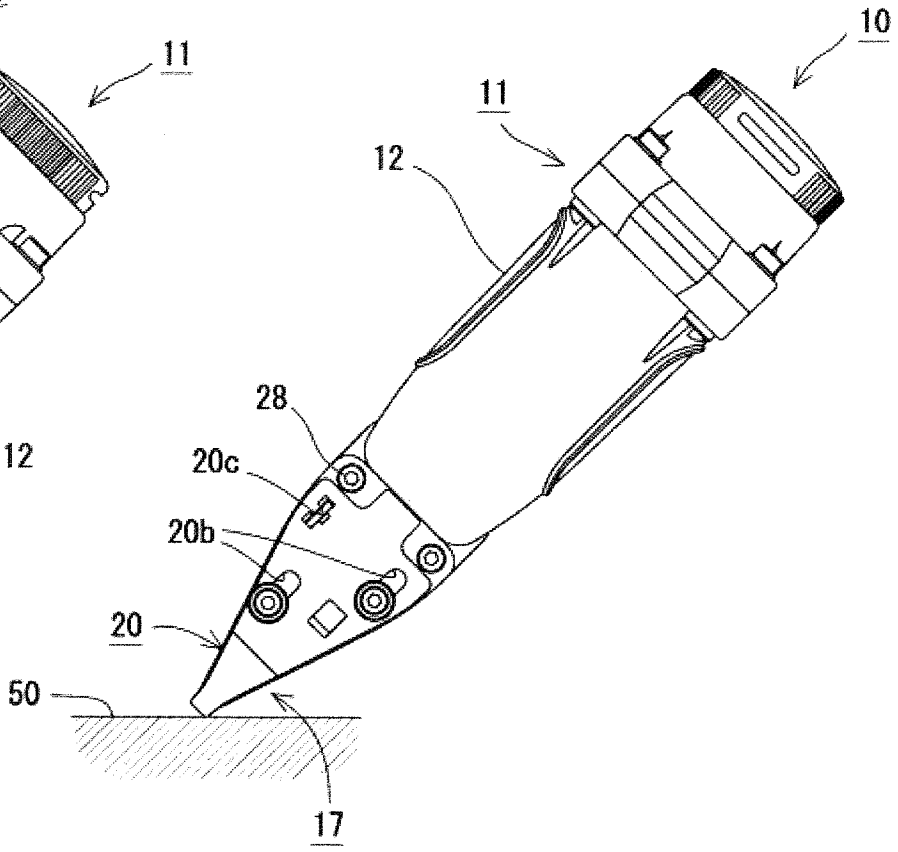
Figure 13A:
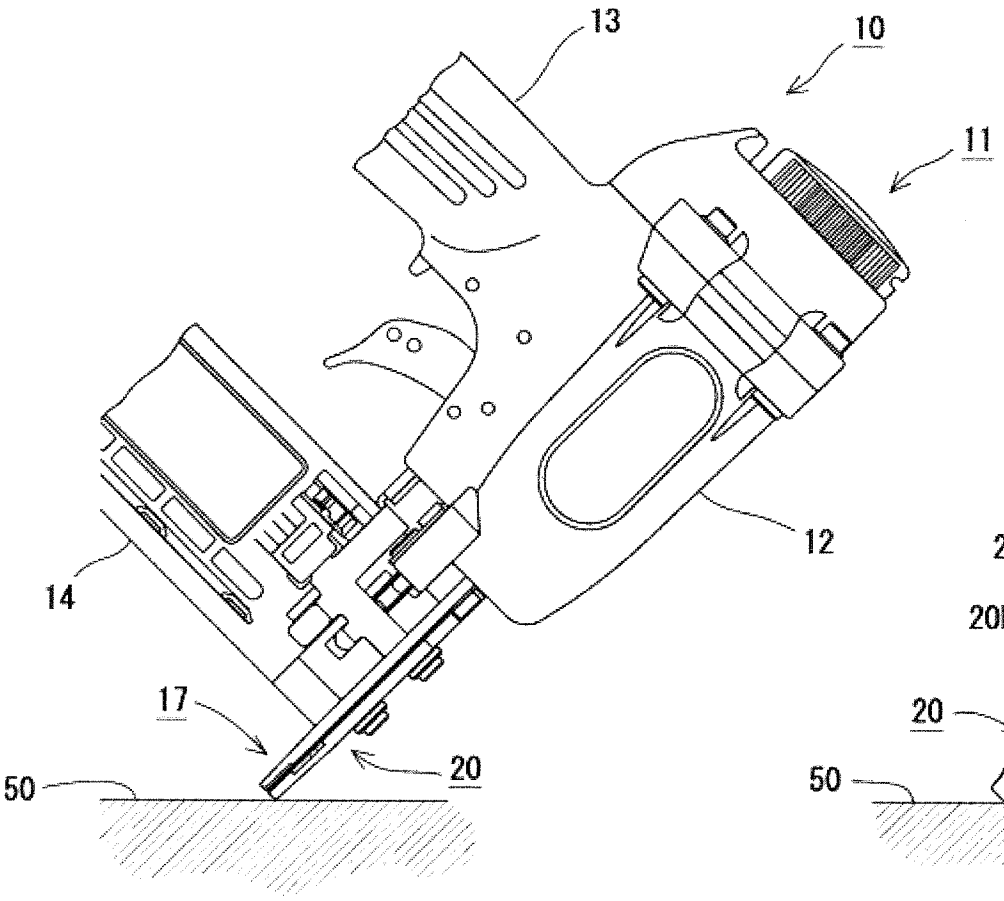

In the conventional driving tool 10, as illustrated in FIGS. 13A and 13B, the contact member 20 can slide only to the same position as the tip of the nose part 17. For this reason, when the oblique driving is performed, the gap occurs between the tip of the nose part 17 and the driving target 50, and the fasteners cannot be deeply driven. In the case of the driving tool 10 according to the present embodiment, this problem does not occur.

Meanwhile, when the position of the top dead center of the contact member 20 is made high in this way, and when the driving is performed while the contact member 20 is being straightly pressed against the driving target 50, or the so-called flat driving is performed, the contact member 20 is not moved to the position of the top dead center thereof (see FIGS. 6A to 7B). For this reason, in a configuration in which the pressing of the contact member 20 is detected when the contact member 20 is moved to the position of the top dead center thereof like the related art, there occurs a problem that the pressing of the contact member 20 cannot be detected during the flat driving and that the driving of the fasteners is not performed. In this regard, since the contact detecting part 22 according to the present embodiment is provided with the button 22*b* that is pushed down in the direction perpendicular to the sliding direction of the contact member 20, and since this button 22*b* is configured to be pushed down by the swinging member 22*c*, even when the contact member 20 is not moved to the position of the top dead center thereof, the pressing of the contact member 20 can be detected (see FIG. 7B). In this way, the button 22*b* is pushed down by the swinging member 22*c*, and thereby the pressing of the contact member 20 can be configured to be detectable at a position other than the position of the top dead center. Due to this configuration, the pressing of the contact member 20 can be detected at a position at which the contact member 20 protrudes beyond the tip of the nose part 17, and the contact member 20 can be moved to the opposite side of the tip of the nose part 17 with the pressing of the contact member 20 detected.

As illustrated in FIG. 9B, a tip width W1 of the contact member 20 is formed to be greater than a tip width W2 of the nose part 17. By setting the tip width W1 of the contact member 20 and the tip width W2 of the nose part 17 in this way, as illustrated in FIG. 9A, when the oblique driving is performed by pressing a lateral end of the contact member 20 against the driving target 50, the lateral end of the contact member 20 which protrudes from a side of the nose part 17 can be engaged with the driving target 50. Therefore, when the pressing of the contact member 20 is performed, it is possible to prevent the nose part 17 from sliding on the driving target 50 and stabilize a posture during the driving. To make engagement between the contact member 20 and the driving target 50 reliable, the lateral end of the contact member 20 which protrudes from the side of the nose part 17 may have a shape pointed in a blade shape in the tip direction. If the lateral end of the contact member 20 has the shape pointed in the blade shape, the pointed lateral end can bite into the driving target 50 to stabilize the posture. Even when the tip width of the contact member 20 is less than or equal to that of the nose part 17 and a protrusion protruding beyond the nose part 17 in a width direction is provided, the same effect is obtained.

An adjustment member 28 for adjusting a movable range of the contact member 20 may be provided. As illustrated in FIG. 9B, the adjustment member 28 according to the present embodiment is mounted to be rotatable relative to the nose part 17 by a bolt 28*a*, and is disposed at a front side of the driving tool 10.

The bolt 28*a* for mounting the adjustment member 28 on the nose part 17 is for mounting the nose part 17 on the tool main body 11 (the tip of the output part 12). In this way, the adjustment member 28 is mounted by the bolt 28*a* for mounting the nose part 17, and the number of components is reduced. Since the adjustment member 28 is easily mounted and demounted by removing the bolt 28*a*, work of, for example, switching presence and absence of the adjustment member 28 and replacing a type of the adjustment member 28 is also easy.

This adjustment member 28 is formed such that a distance from a rotational center thereof to a circumferential surface thereof differs in at least two places. To be specific, the adjustment member 28 is formed such that the distance from the rotational center thereof to the circumferential surface thereof differs due to a protrusion part 28*b* protruding in a circumferential direction and an outer circumferential part 28*d* other than the protrusion part 28*b*. The adjustment member 28 is configured to decide the top dead center of the contact member 20 by engaging a butting part 20*d* formed at a rear end of the contact member 20 with the circumferential surface thereof which is different in distance from the rotational center thereof. That is, the top dead center of the contact member 20 is configured to be able to be set to be low if the protrusion 28*b* is engaged with the butting part 20*d*, and to be high if the outer circumferential part 28*d* is engaged with the butting part 20*d*.

When the adjustment member 28 is rotated to enter into a first state illustrated in FIGS. 4A and 4B, the outer circumferential part 28*d* is configured to face the butting part 20*d* formed at the rear end of the contact member 20. In the first state, the contact member 20 is made slidable until the butting part 20*d* is butted against the outer circumferential part 28*d*. On this occasion, the tip of the contact member 20 is configured to be slidable to the side opposite to and beyond the tip of the nose part 17 as illustrated in FIGS. 4B and 5B. In this way, the top dead center of the contact member 20 can be set to be most suitable for the oblique driving if the adjustment member 28 enters into the first state.

Figure 6A:
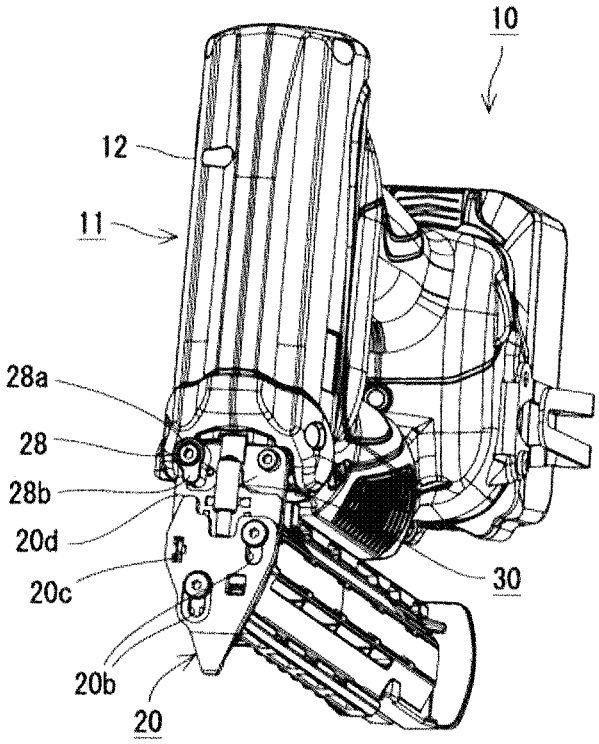
Figure 6B:
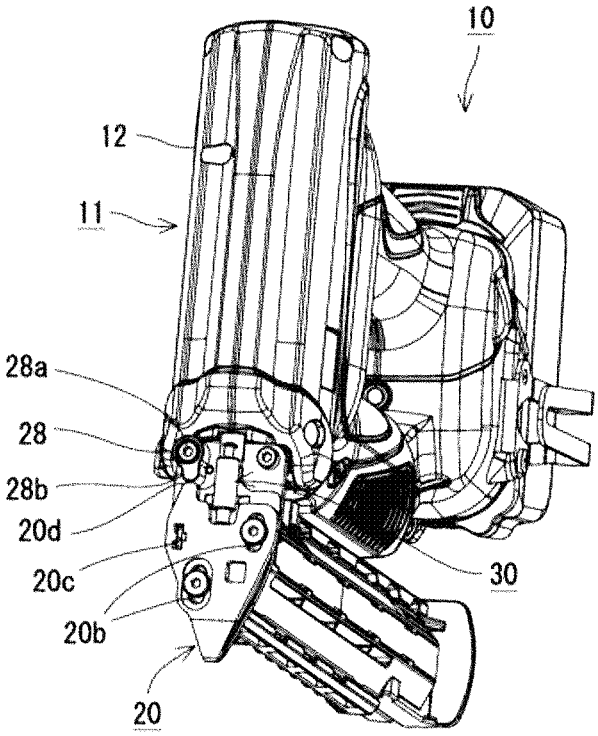
Figure 7A:
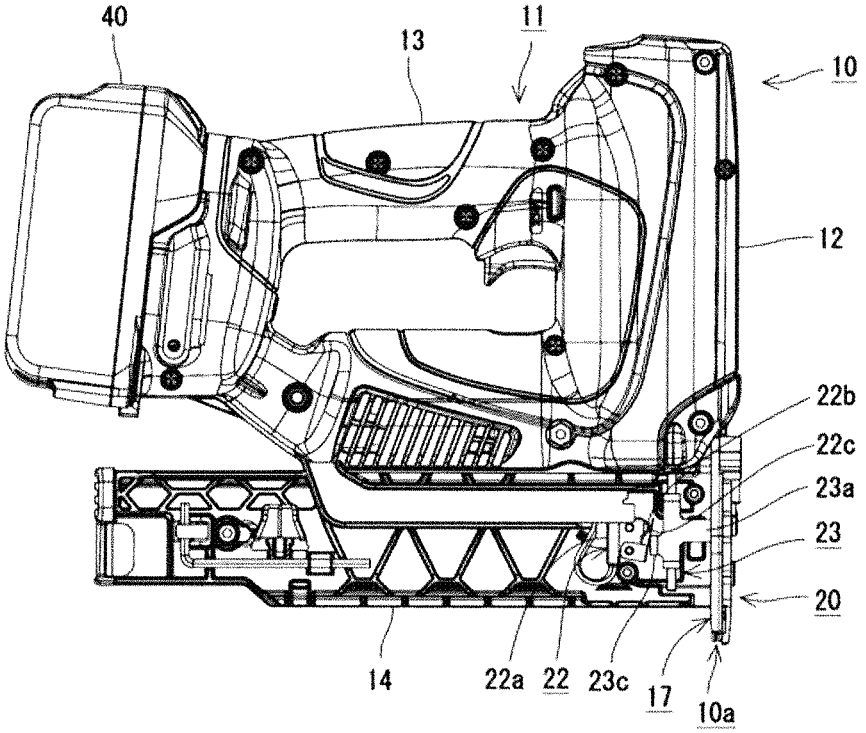
Figure 7B:
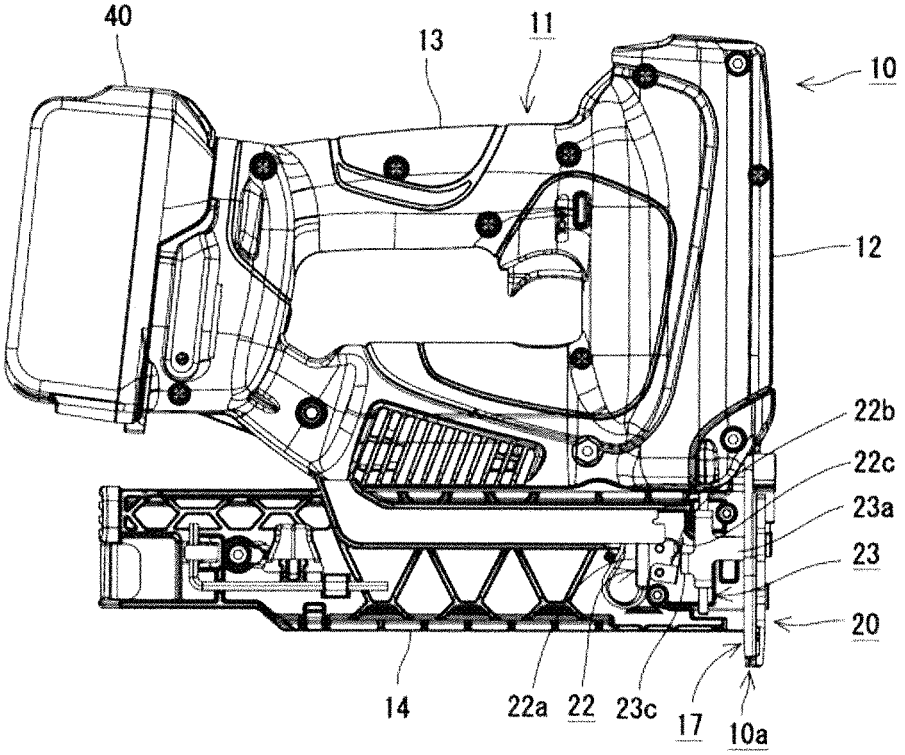

When the adjustment member 28 is rotated to enter into a second state illustrated in FIGS. 6A and 6B, the protrusion 28*b* is configured to face the butting part 20*d* formed at the rear end of the contact member 20. In the second state, the contact member 20 is made slidable until the butting part 20*d* is butted against the protrusion 28*b*. On this occasion, the tip of the contact member 20 is configured to be slidable to the same position as the tip of the nose part 17 (the tip of the contact member 20 is regulated not to be slidable to the side opposite to and beyond the tip of the nose part 17) as illustrated in FIGS. 6B and 7B. In this way, the top dead center of the contact member 20 can be set such that a driving depth during flat driving is made proper if the adjustment member 28 enters into the second state. In the present embodiment, when the adjustment member 28 is in the second state, the tip of the contact member 20 is slidable to the same position of the tip of the nose part 17. However, the invention is not limited thereto. When the adjustment member 28 is in the second state, the tip of the contact member 20 may be configured to be slidable to a given position close to the tip of the nose part 17.

The adjustment member 28 is not limited to the mode mentioned above.

For example, as illustrated in FIGS. 10A to 10F, a plurality of protrusions 28*b* may be provided such that the driving depth can be adjusted step by step. In the adjustment member 28 illustrated in FIG. 10, two types of small and large protrusions 28*b* are provided. If the adjustment member 28 is set to a state illustrated in FIGS. 10A and 10B, the outer circumferential part 28*d* faces the butting part 20*d* of the contact member 20 so that the driving depth can be set to the maximum driving depth. In addition, if the adjustment member 28 is set to a state illustrated in FIGS. 10C and 10D, the large protrusion 28*b* faces the butting part 20*d* of the contact member 20 so that the driving depth can be set to the minimum driving depth. If the adjustment member 28 is set to a state illustrated in FIGS. 10E and 10F, the small protrusion 28*b* faces the butting part 20*d* of the contact member 20 so that the driving depth can be set to an intermediate driving depth.

The adjustment member 28 illustrated in FIGS. 11A to 11F may be used. This adjustment member 28 is provided with an oblique part 28*c* that is a cam-like circumferential surface inclined gradually from the protrusion 28*b*. The driving depth is allowed to be steplessly adjusted in a seamless way by at which position of the oblique part 28*c* the butting part 20*d* of the contact member 20 is received. That is, if the adjustment member 28 is set to a state illustrated in FIGS. 11A and 11B, a lowest part of the oblique part 28*c* faces the butting part 20*d* of the contact member 20 so that the driving depth can be set to the maximum driving depth. In addition, if the adjustment member 28 is set to a state illustrated in FIGS. 11C and 11D, the large protrusion 28*b* faces the butting part 20*d* of the contact member 20 so that the driving depth can be set to the minimum driving depth. If the adjustment member 28 is set to a state illustrated in FIGS. 11E and 11F, a middle part of the oblique part 28*c* faces the butting part 20*d* of the contact member 20 so that the driving depth can be set to an intermediate driving depth.

Figure 12:
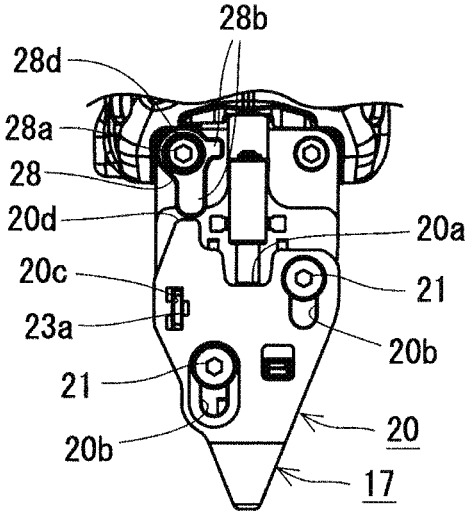
FIG. 12 is a view illustrating an adjustment member according to a third modification, and is a view of a state in which sliding of the contact member is locked.

The adjustment member 28 may be regulable such that the contact member 20 does not slide to a position at which the contact detecting part 22 is turned on. That is, as illustrated in FIG. 12, if the adjustment member 28 is set to have the protrusion 28*b* protruding to nearly come into contact with the butting part 20*d* of the contact member 20 in a state in which the contact member 20 protrudes, the contact member 20 can be hardly moved. For this reason, the contact member 20 is not made slidable to the position at which the contact detecting part 22 is turned on. In this way, if the contact member 20 is locked by the adjustment member 28, this enters into a state in which the driving cannot be performed, and thus safety can be secured. When the driving is performed, if the adjustment member 28 is rotated, then the locking can be simply released.

As described above, according to the present embodiment, the contact member 20 is made slidable to the side opposite to and beyond the tip of the nose part 17. According to this configuration, when the contact member 20 is obliquely pressed against the driving target 50 and is moved to the top dead center thereof, the contact member 20 can be pushed into the back beyond the tip of the nose part 17. For this reason, since the tip of the nose part 17 can approach the driving target 50, the fasteners can be deeply driven even when the oblique driving is performed. Even when the contact member 20 is pressed against the driving target 50 on the straight (in the case of the so-called flat driving), since the tip of the nose part 17 can be brought into close contact with the driving target 50, the fasteners can be deeply driven.

Even when the driving tool 10 falls from a tip side thereof, it is difficult for the contact member 20 to be broken. That is, in the conventional driving tool 10, when the driving tool 10 falls from the tip side thereof, the contact member 20 bears the whole impact at the time of falling, and the contact member 20 leads to breakage. In this regard, according to the present embodiment, the contact member 20 slides, and thereby the nose part 17 is hit against the ground so that an impact is dispersed to the contact member 20 and the nose part 17 (the tool main body 11). Therefore, it is possible to prevent the breakage of the contact member 20 at the time of falling.

The contact detecting part 22 is provided with the button 22*b* that is pushed down in the direction perpendicular to the sliding direction of the contact member 20. According to this configuration, when the contact member 20 is moved to a certain extent, the button 22*b* is pushed down. In other words, even when the contact member 20 is not moved to the top dead center thereof, the sign for validating the operation of the trigger 15 is turned on. Therefore, as in the present embodiment, when the top dead center of the contact member 20 is provided at the side opposite to and beyond the tip of the nose part 17, even when the contact member 20 is not moved to the top dead center thereof, the operation of the trigger 15 is validated. Therefore, even when the contact member 20 cannot be moved to the top dead center thereof at the time of flat driving, no sign failure occurs. Even when the contact member 20 wants to be moved to the top dead center thereof at the time of oblique driving, the contact detecting part 22 does not hinder the sliding of the contact member 20, and thus contact member 20 can perform a stroke to the top dead center thereof.

The tip width W1 of the contact member 20 is formed to be greater than the tip width W2 of the nose part 17. According to this configuration, when the oblique driving is performed by pressing the lateral end of the contact member 20 against the driving target 50, the lateral end of the contact member 20 which protrudes from the side of the nose part 17 can be engaged with the driving target 50. Therefore, the nose part 17 can be prevented from sliding on the driving target 50 when the pressing action of the contact member 20 is performed, and the posture during driving can be stabilized.

The driving tool 10 is provided with the adjustment member 28 configured to adjust the movable range of the contact member 20, and the adjustment member 28 acquires the first state in which the tip of the contact member 20 is made slidable to the side opposite to and beyond the tip of the nose part 17 and the second state in which the tip of the contact member 20 is regulated not to be slidable to the side opposite to and beyond the tip of the nose part 17. According to this configuration, the movable range of the contact member 20 can be adjusted according to circumstances of usage. For example, it is possible to adjust such that the adjustment member 28 is set to the first state at the time of oblique driving and the adjustment member 28 is set to the second state at the time of flat driving.

The adjustment member 28 is a member mounted to be rotatable relative to the nose part 17, is formed such that the distance from the rotational center thereof to the circumferential surface thereof differs in at least two spots, and decides the top dead center of the contact member 20 by engaging the contact member 20 with the circumferential surface thereof. According to this configuration, since the movable range of the contact member 20 can be adjusted only by rotating the adjustment member 28, the operability is good.

Since the adjustment member 28 is directly engaged with the contact member 20, the driving depth can be adjusted with the minimum number of components. Since no intermediate member is used, only a tolerance between the adjustment member 28 and the contact member 20 may be taken into consideration, and an adjustment mechanism having high accuracy can be provided.

If the distance from the rotational center to the circumferential surface is set to be able to be changed step by step, the adjustment mechanism capable of adjusting the driving depth step by step can be provided. If the circumferential surface of the adjustment member 28 is formed in a cam shape, the adjustment mechanism capable of steplessly adjusting the driving depth in a seamless way can be provided.

The adjustment member 28 is disposed at the front side of the driving tool 10. According to this configuration, since visibility of the side of the driving tool 10 is not marred, driving work can be performed while looking at a driving position from the side. Since it is easy to visually observe the state of the adjustment member 28, it is easy to check the setting of the driving depth, and it is possible to perform reliable driving work.

The adjustment member 28 is regulable such that the contact member 20 does not slide to the position at which the contact detecting part 22 detects the pressing. According to this configuration, the contact member 20 can be locked such that the driving cannot be performed by the adjustment member 28 for adjusting the driving depth.

In the above embodiment, the contact detecting part 22 is formed with the switch. However, it will do if the contact detecting part 22 can detect that the contact member 20 is pressed against the driving target 50, and the contact detecting part 22 may be another aspect. For example, the contact detecting part 22 may be configured of a member that is mechanically actuated without using an electrical switch. When the contact detecting part 22 is configured without using the electrical switch, the contact detecting part 22 may mechanically lock or disable the operation of the trigger 15 using well-known unit.

The driving tool of the present disclosure may be configured as follows:

(1) A driving tool configured to drive fasteners shot from an ejection port into a driving target, the driving tool comprising:

a trigger configured to carry out a driving action;

a nose part formed with the ejection port;

a contact member provided to be slidable relative to the nose part and is capable of being pressed against the driving target; and a contact detecting part configured to detect that the contact member is pressed against the driving target, wherein the driving action is carried out when the contact detecting part detects that the contact member is pressed against the driving target and when the trigger is operated, and wherein the contact member is slidable to a side opposite to and beyond a tip of the nose part.

(2) The driving tool according to (1), wherein the contact detecting part is capable of detecting that the contact member is pressed against the driving target when the contact member is in a middle of sliding.

(3) The driving tool according to (1), wherein the contact detecting part is capable of detecting that the contact member is pressed against the driving target when the contact member is in a tip side than the tip of the nose part.

(4) The driving tool according to any one of (1) to (3), wherein the contact detecting part comprises a button capable of being pushed down in a direction perpendicular to a sliding direction of the contact member.

(5) The driving tool according to any one of (1) to (4) further comprising a switch depressing member that moves integrally with the contact member and actuates the contact detecting part.

(6) The driving tool according to (4) further comprising a switch depressing member that moves integrally with the contact member and actuates the contact detecting part, wherein the contact detecting part comprises a swinging member that is pushed by the switch depressing member when the switch depressing member moves, and is swung to push down the button.

(7) The driving tool according to (6), wherein the swinging member is arranged so as not to prevent the movement of the switch depressing member toward the side opposite to the tip of the nose part after the swinging member pushed down the button.

(8) The driving tool according to any one of (5) to (7) further comprising a sliding support shaft configured to guide a movement of the switch depressing member.

(9) The driving tool according to any one of (1) to (8), wherein a tip width of the contact member is greater than a tip width of the nose part.

(10) The driving tool according to any one of (1) to (9), wherein the driving tool comprises an adjustment member configured to adjust a movable range of the contact member, wherein the adjustment member has a first state and a second state, wherein in the first state, a tip of the contact member is made slidable to the side opposite to and beyond the tip of the nose part, and wherein in the second state, the tip of the contact member is regulated not to be slidable to the side opposite to and beyond the tip of the nose part.

(11) The driving tool according to (10), wherein the adjustment member is rotatably mounted to the nose part, comprises a plurality of protrusions in which distances between a rotational center of the adjustment member and the plurality of protrusions are different, and decides a top dead center of the contact member by engaging the contact member with the protrusion.

(12) The driving tool according to (10) or (11), wherein the adjustment member is mounted to be rotatable relative to the nose part, is formed such that a distance from a rotational center to a circumferential surface differs in at least two spots, and decides a top dead center of the contact member by engaging the contact member with the circumferential surface.

(13) The driving tool according to any one of (10) to (12), wherein the adjustment member is disposed at a front side of the driving tool.

(14) The driving tool according to (13), wherein the adjustment member is rotatably mounted to the nose part by a bolt configured to mount the nose part on a tool main body.

(15) The driving tool according to any one of (10) to (14), wherein the adjustment member is regulable such that the contact member does not slide to a position at which the contact detecting part detects that the contact member is pressed against the driving target.

The invention claimed is:

1. A driving tool configured to drive fasteners shot from an ejection port into a driving target, the driving tool comprising:

a trigger configured to carry out a driving action;

a nose part formed with the ejection port;

a contact member provided to be slidable relative to the nose part and is capable of being pressed against the driving target; and a contact detecting part configured to detect that the contact member is pressed against the driving target, wherein the driving action is carried out when the contact detecting part detects that the contact member is pressed against the driving target and when the trigger is operated, and wherein the contact member is slidable with respect to the nose part between a first position prior to contact with the driving target and a second position after contact with the driving target, wherein in the first position a tip of the contact member facing the driving target protrudes farther away from a machine body of the driving tool than a tip of the nose part, and in the second position the tip of the contact member facing the driving target is recessed from the tip of the nose part such that the tip of the contact member facing the driving target is closer to the machine body than the tip of the nose part, and the tip of the contact member facing the driving target is on an opposite side of the tip of the nose part in the second position compared to the first position with respect to a driving direction of a fastener.

2. The driving tool according to claim 1, wherein the contact detecting part comprises a button capable of being pushed down in a direction perpendicular to a sliding direction of the contact member.

3. The driving tool according to claim 1 further comprising a switch depressing member that moves integrally with the contact member and actuates the contact detecting part.

4. The driving tool according to claim 1, wherein a tip width of the tip of the contact member is greater than a tip width of the tip of the nose part.

5. The driving tool according to claim 1, wherein the driving tool comprises an adjustment member configured to adjust a movable range of the contact member, wherein the adjustment member has a first state and a second state, wherein in the first state, the tip of the contact member is made slidable to the side opposite to and beyond the tip of the nose part, and wherein in the second state, the tip of the contact member is regulated not to be slidable to the side opposite to and beyond the tip of the nose part.

6. The driving tool according to claim 5, wherein the adjustment member is disposed at a front side of the driving tool.

7. The driving tool according to claim 5, wherein the adjustment member is regulable such that the contact member does not slide to a position at which the contact detecting part detects that the contact member is pressed against the driving target.

8. The driving tool according to claim 5, further including a biasing unit which biases the contact member toward said first position, and wherein upon contact of the contact member with the driving target the contact member moves toward the second position in opposition to a bias force of the biasing unit.

9. The driving tool according to claim 1, further including a biasing unit which biases the contact member toward said first position, and wherein upon contact of the contact member with the driving target the contact member moves toward the second position in opposition to a bias force of the biasing unit.

10. A driving tool configured to drive fasteners shot from an ejection port into a driving target, the driving tool comprising:

a trigger configured to carry out a driving action;

a nose part formed with the ejection port;

a contact member provided to be slidable relative to the nose part and is capable of being pressed against the driving target; and a contact detecting part configured to detect that the contact member is pressed against the driving target, wherein the driving action is carried out when the contact detecting part detects that the contact member is pressed against the driving target and when the trigger is operated, and wherein the contact member is slidable to a side opposite to and beyond a tip of the nose part;

wherein the contact detecting part comprises a button capable of being pushed down in a direction perpendicular to a sliding direction of the contact member;

the driving tool further comprising a switch depressing member that moves integrally with the contact member and actuates the contact detecting part, wherein the contact detecting part comprises a swinging member that is pushed by the switch depressing member when the switch depressing member moves, and is swung to push down the button.

11. A driving tool configured to drive fasteners shot from an ejection port into a driving target, the driving tool comprising:

a trigger configured to carry out a driving action;

a nose part formed with the ejection port;

a contact member provided to be slidable relative to the nose part and is capable of being pressed against the driving target; and a contact detecting part configured to detect that the contact member is pressed against the driving target, wherein the driving action is carried out when the contact detecting part detects that the contact member is pressed against the driving target and when the trigger is operated, and wherein the contact member is slidable to a side opposite to and beyond a tip of the nose part;

the driving tool further comprising a switch depressing member that moves integrally with the contact member and actuates the contact detecting part, and a sliding support shaft configured to guide a movement of the switch depressing member.

12. A driving tool configured to drive fasteners shot from an ejection port into a driving target, the driving tool comprising:

a trigger configured to carry out a driving action;

a nose part formed with the ejection port;

a contact member provided to be slidable relative to the nose part and is capable of being pressed against the driving target; and a contact detecting part configured to detect that the contact member is pressed against the driving target, wherein the driving action is carried out when the contact detecting part detects that the contact member is pressed against the driving target and when the trigger is operated, and wherein the contact member is slidable to a side opposite to and beyond a tip of the nose part, wherein the driving tool comprises an adjustment member configured to adjust a movable range of the contact member, wherein the adjustment member has a first state and a second state, wherein in the first state, a tip of the contact member is made slidable to the side opposite to and beyond the tip of the nose part, wherein in the second state, the tip of the contact member is regulated not to be slidable to the side opposite to and beyond the tip of the nose part, and wherein the adjustment member is mounted to be rotatable relative to the nose part, is formed such that a distance from a rotational center to a circumferential surface differs in at least two spots, and decides a top dead center of the contact member by engaging the contact member with the circumferential surface.

* * * * *